United States Patent [19]

Spriggs

[11] 3,963,074

[45] June 15, 1976

[54] LOCKING DEVICE FOR USE IN WELL TUBING

[75] Inventor: Dennis Mitchel Spriggs, Dallas, Tex.

[73] Assignee: Dresser Industries, Inc., Dallas, Tex.

[22] Filed: May 30, 1975

[21] Appl. No.: 582,314

[52] U.S. Cl. ..... 166/206; 166/217

[51] Int. Cl.[2] ..... E21B 23/02

[58] Field of Search ..... 166/206, 214, 216, 217

[56] References Cited

UNITED STATES PATENTS

| | | | |
|---|---|---|---|
| 2,948,339 | 8/1966 | Fredd | 166/216 |
| 2,991,835 | 7/1961 | Schwab | 166/214 |
| 3,207,224 | 9/1965 | Schramm | 166/217 |
| 3,818,988 | 6/1974 | Read | 166/216 |

*Primary Examiner*—James A. Leppink
*Attorney, Agent, or Firm*—Michael J. Caddell

[57] ABSTRACT

An unitary tubular locking member is rotatably mounted on a mandrel along with sleeve means for pivoting the locking member into abutting engagement inside a landing nipple in a tubing string.

9 Claims, 6 Drawing Figures

LOCKING DEVICE FOR USE IN WELL TUBING

BACKGROUND OF THE INVENTION

This invention generally involves a locking mechanism for suspending well flow controls in a landing sub in a tubing or casing string disposed in an oil well borehole.

The usual type of locking devices for suspending flow control devices, such as valves, in a landing sub utilizes expandable collet fingers having bevelled shoulders arranged to be expanded outward and locked into matching internal channels in the landing sub or landing nipple. The spring type collets are arranged to flex radially inward when passing through obstructions and when entering the landing sub. When it is desirable to lock the tool in the sub, a sleeve or wedge is driven up inside the spring collets to prevent their inward flexing and to fixedly secure the collet shoulders in the internal sub channel.

A disadvantage of the spring collet type of locks is that they tend to be difficult to set completely, and also that the bevelled shoulders may be pulled out of the locking channels even when set because of the angled sides of the bevel shoulders which do not provide a truly positive abutment in the sub channel.

The present invention provides a positive locking mechanism which utilizes a single, unitary, locking member to overcome the disadvantages of the prior art.

DESCRIPTION OF THE PREFERRED EMBODIMENTS

Figure 1:
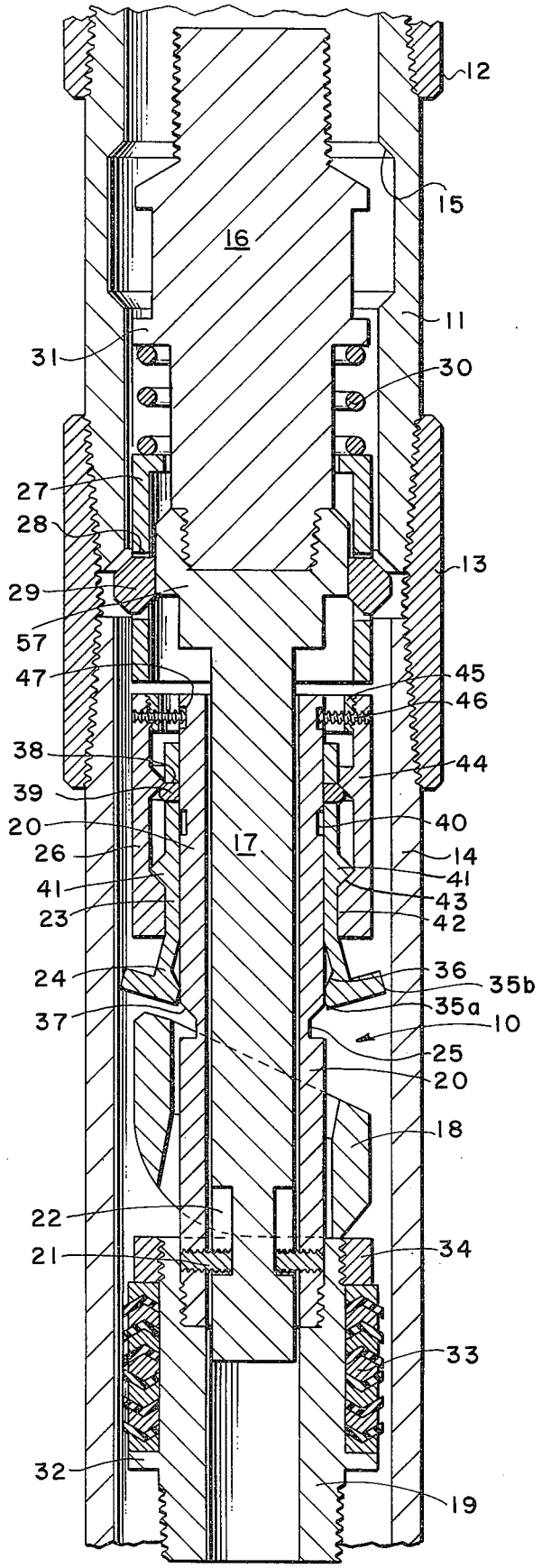
FIGS. 1–3 are cross-sectional schematic illustrations of one embodiment of this invention in various stages of operation.
Figure 2:
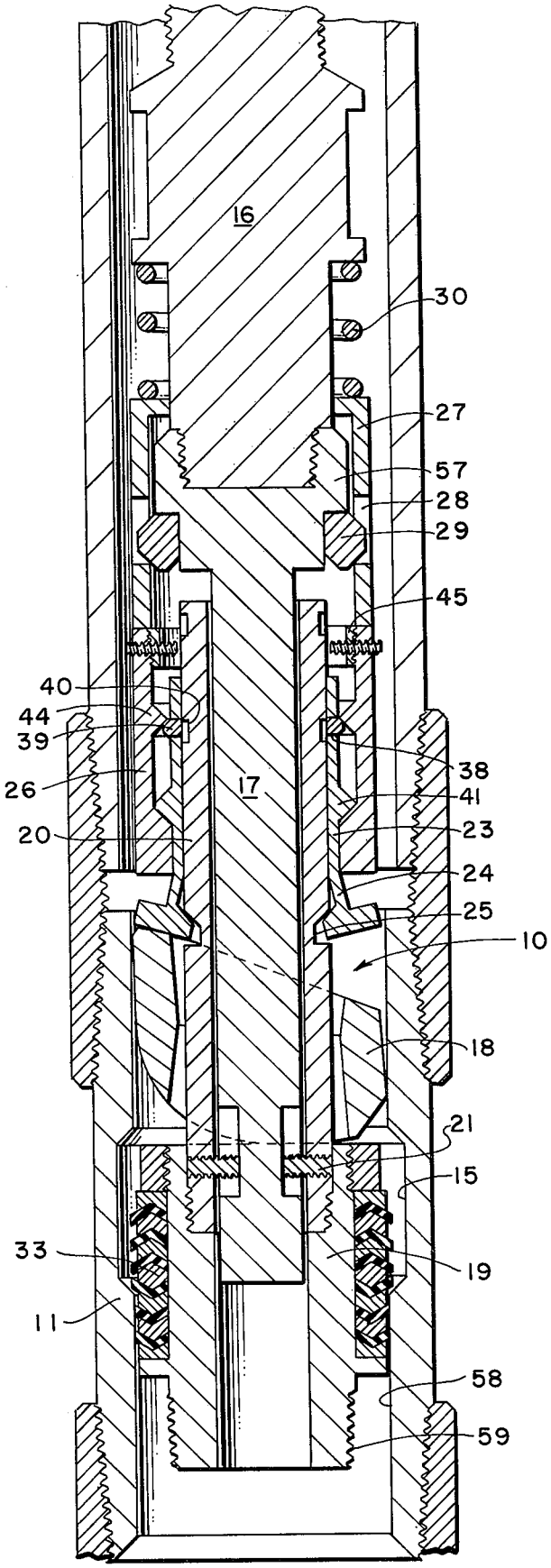
Figure 3:
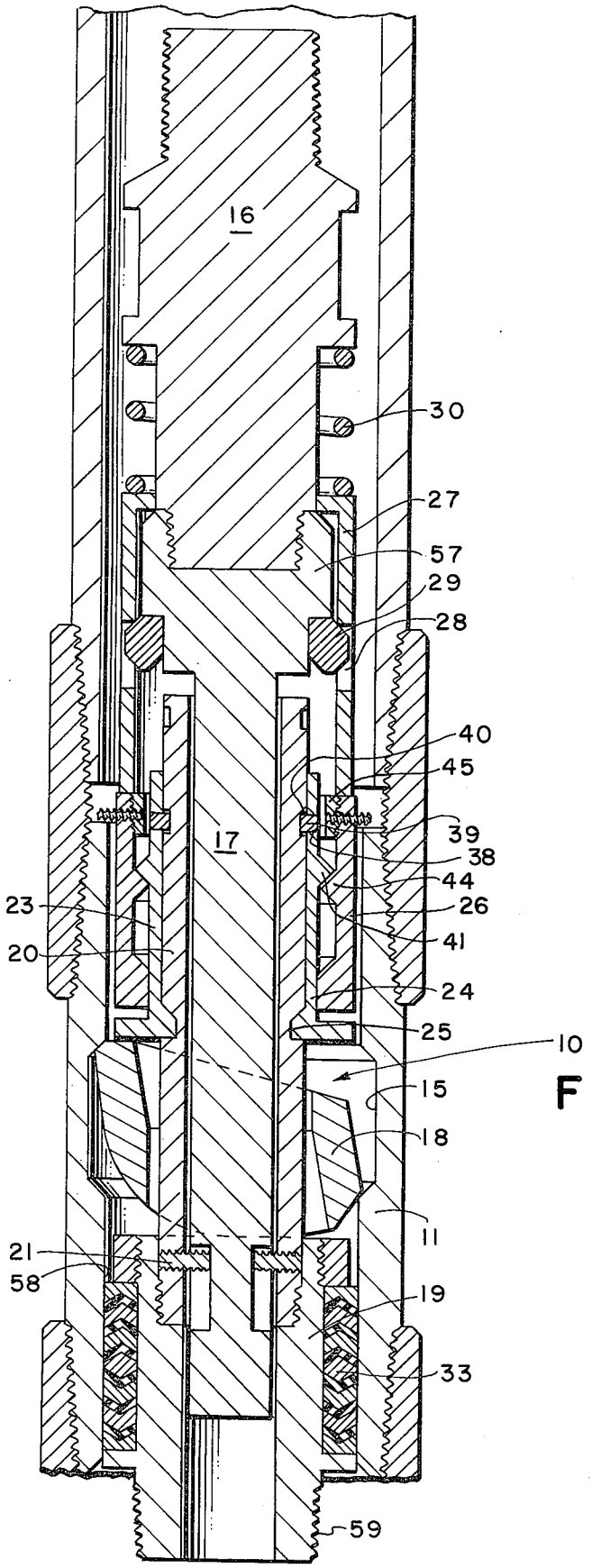

Referring to FIGS. 1–3, the locking mechanism 10 is shown located concentrically inside a landing sub assembly 11, which assembly has an upper threaded collar 12 and a lower threaded collar 13. The upper threaded collar 12, threadedly engaged on sub 11, is arranged to be threadedly engaged into the lower end of a section of well conduit; and collar 13, which is threadedly engaged at the bottom of sub 11, is arranged for threaded engagement with the upper end of a lower section of conduit 14. The landing sub 11 is characterized in having an inner angular locking channel 15 formed in the wall thereof.

The locking mechanism 10 has an upper mandrel 16 threadedly engaged in a lower mandrel 17. A tubular locking member 18 having a dual-axis bore passage therethrough is concentrically located about the lower mandrel 17. A retention collar 19 is located below member 18 in abutting relationship therewith. A mandrel sleeve 20 is located concentrically between lower mandrel 17 and locking member 18. Sleeve 20 is frangibly secured to mandrel 17 by means of shear screws 21 threadedly engaged in sleeve 20 and projecting inward with engagement with a circumferential channel 22 formed in the lower end of mandrel 17.

Retention collar 19 is threadedly engaged with mandrel sleeve 20 and abuts member 18 along its lower edge. A setting sleeve 23 is slidably located externally on the upper portion of mandrel sleeve 20 and has spring fingers 24 arranged for engagement in a circumferential channel 25 formed in the outer wall of mandrel sleeve 20. A locking sleeve 26 is slidably located on sleeve 23. A spring abutment collar 27 is slidably located about the upper and lower mandrels 16 and 17 and contains a plurality of radial openings 28 in which are located locking pins 29. A coil compression spring 30 is located atop collar 27 and is in abutment therewith and with an outwardly projecting flange 31 formed on mandrel 16.

Retention collar 19 is provided with a lower annular external flange 32 above which is located annular packing seals 33 held by seal retainer ring 34 which is threadedly engaged at the upper end of retention collar 19.

Setting sleeve 23 has at its lower end a plurality of the spring arms 24, each of which has a lower inwardly projecting shoulder area **35*a* and outwardly projecting shoulder area 35*b*. Shoulder 35*a* is adapted for close fitting relationship in channel 25. An upper sloping face 36 on shoulder 35*a* is adapted for slidable movement along a correspondingly angled sloping surface 37 of channel 25. Setting sleeve 23 further has a plurality of holes or openings 38 passing through the wall thereof through which are slidably located engagement pins 39. A circumferential channel 40 is formed in the external wall of mandrel sleeve 20 and is sized to allow snug engagement of pins 39 therein upon proper alignment of sleeve 23 with mandrel sleeve 20. Setting sleeve 23 is also provided with an annular external wedge shoulder 41 projecting outwardly therefrom. Locking sleeve 26 is provided with a lower inner annular shoulder 42 having a sloping face 43 which matches shoulder 41 of sleeve 23. Locking sleeve 26 is also provided with an inner annular wedge shoulder 44 projecting inward to abut pins 39**.

A fishing tool attachment ring 45 is threadedly engaged in the upper end of locking sleeve 26 and a plurality of shear screws 46 are threadedly engaged and pass through the wall of sleeve 26 to project into an external channel 47 in mandrel sleeve 20.

Figure 4:
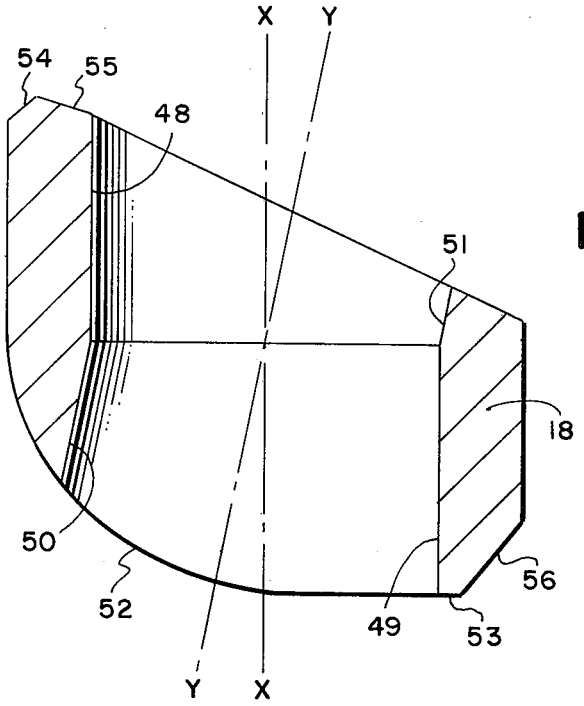
FIG. 4 is an isometric view of the rotatable locking member.

Referring now to FIG. 4, a cross-sectional view of tubular member 18 is shown to better illustrate the particular features of this member. Tubular member 18 comprises a generally cylindrical tubular structure having two intersecting bore passages passing therethrough. The longitudinal central axes of the two bore passages are designated at X—X and Y—Y. The bore passage associated with axis X—X is defined by cylindrical inner walls 48 and 49. The bore passage associated with axis Y—Y is defined by cylindrical walls 50 and 51. The diameters of the bore passages X—X and Y—Y are larger than the diameter of mandrel sleeve 20. The tubular member is designed to have an arcuate pivot surface 52 along the bottom side thereof, lower abutment surfaces 53 and 56 along the lower right hand side of the member wall, and upper abutment surfaces 54 and 55 at the top of the left hand wall. Lower abutment surface 53 extends across the bottom of the tubular member and intersects arcuate surface 52 preferably near or between the X—X axis and the Y—Y axis.

When the tubular member is located about mandrel sleeve 20, such that the longitudinal axis X—X is substantially aligned with the longitudinal axis of sleeve 20, the locking member is in the relaxed, non-locking position. When the member is rotated, such that axis Y—Y becomes substantially parallel to the axis of sleeve 20, then abutment surfaces 54 and 56 have been rotated outwardly for engagement in the appropriate channel or opening in the wall of the tubing or the sub 11.

In typical operation, the locking mechanism 10 is lowered by means of wireline (not shown) to the desired location in the tubing string which the operator can determine from a wireline apparatus measuring system. A weighted member may be placed atop the locking mechanism to facilitate downward movement through the tubing string. The locking mechanism is arranged so that it may move downward through any number of obstructions similar to the landing sub 11 without engaging or activating the locking member. Setting of the locking mechanism in the desired location is achieved by bringing the mechanism back up through the desired landing sub and then lowering the mechanism 10 back into the sub whereupon engagement of the locking mechanism will occur in the sub setting channel 15.

In FIG. 1, the mechanism 10 is illustrated having passed through the landing sub 11. To accomplish such passes, locking pins 29 are located above the upper end of mandrel 17 and are flexed inward by the engagement of the outward bevelled shoulders of pins 29 with the inner wall of sub 11. The tool is placed in the tubing string in the condition illustrated in FIG. 1. As it moves downward in the string, the pins 29 will engage any inwardly projecting shoulders or obstructions, and will be pushed upward moving abutment collar 27 upward thereby compressing coil spring 30 against shoulder 31. Pins 29 will continue to move collar 27 upward until the pins are allowed to slide inward against mandrel 16, thereby allowing the mechanism to move downward through the shoulder or obstruction. The compressed coil spring 30 will continue to maintain a downward biasing force on collar 27 and pins 29 so that as soon as an annular open area, such as that formed by collar 13 below sub 11 is reached, the pins will be cammed up on enlarged end 57 of mandrel 17 into the annular opening.

At this point, the mechanism is ready to be engaged in locking relationship in sub 11. This is accomplished by pulling up once again on mandrel 16 and 17. At this point, pins 29 will abut the lower end of the sub 11 and prevent upper movement of collar 27 and sleeve 26. As a result, the inner mandrel 16 and 17 will move upward shearing pins 46 until the enlarged area 57 passes beneath pins 29 and they are consequently wedged inward to set in the reduced area of mandrel 17 below end 57.

FIG. 2 illustrates the mechanism as it is being lowered back through the landing sub 11. When seals 33 engage the lower restricted bore portion 58, this will set up friction between the seals and the seal bore 58 and continued downward movement of the locking mechanism 10 through the sub will result in a partial telescopic collapsing of the mechanism with the inner mandrels 16 and 17 moving downward through the seal retention collar 19 and mandrel sleeve 20. Simultaneously, the abutment of pins 29 within radial slots 28 and shoulders 57 on mandrel 17 will serve to move collar 27 downwards into abutment with sleeve 26.

The upper inner shoulder 44 of sleeve 26 abuts pins 39 passing through radial openings 38 in the wall of setting sleeve 23 which abutment serves to move sleeve 23 downward as sleeve 26 moves. The downward movement of sleeve 23 moves it into abutment with the top abutment surface 55 of member 18. Simultaneously, the friction force acting on seal retention collar 19 arising from the friction of seals 33 in seal bore 58 serves to move collar 19 upward relative to the tubular member 18. The upward movement of collar 19 results in abutment with the lower abutment surface 53 of the locking member. This simultaneous abutment from above on surface 55 and from below on surface 53 applies a rotational moment to the member 18 which tends to rotate it in a counterclockwise direction until it has contacted the inner wall of the sub 11 above channel 15. Upon obtaining this abutment with wall 18, as illustrated in FIG. 2, the seals 33 will resume movement into seal bore 58 until the moment the uppermost edge of the member 18 clears the top portion of locking channel 15. At this point, further rotation of locking member 18 resulting from the continuously applied rotational moment thereon serves to move the abutment faces 54 and 56 outward to engage the sloping walls of channel 15 as illustrated in FIG. 3.

At the moment the locking member rotates to its fully engaged locking position as shown in FIG. 3, spring fingers 24 of setting sleeve 23 will have moved down a sufficient distance to fully engage in retention channel 25. Also with this engagement, the pins 39 will have moved inward into groove 40 allowing further downward movement of locking sleeve 26 until shoulder 44 of locking sleeve 26 has passed over shoulder 43. At this point, the locking sleeve has moved into a position overlapping spring fingers 24 thereby pinning them into permanent engagement in channel 25, with the abutment of shoulder 44 with shoulder 43 serving to maintain the locking sleeve over the spring fingers. This locks member 18 in its radially outwardly expanded position as shown in FIG. 3. Member 18 will now prevent upward or downward movement of the locking mechanism in the sub by the abutment of face 55 with the upper sloped wall of channel 15 and by abutment of surface 56 with the lower sloping wall of channel 15. The location of a flow control device, such as a safety valve within a tubing string, may be easily accomplished by previously attaching the flow control device to the threaded section 59 at the bottom of collar 19.

After the flow control device has been positioned in the well, the setting assembly, comprising mandrels 16 and 17, coil spring 30, and collar 27, is removed by pulling up on the wireline attached to mandrel 16, shearing screws 21. After removal of these components from the tubing string, the flow control valve is ready for use.

When it is desired to remove the locking mechanism and the flow valve from the borehole, a fishing tool may then be lowered downward through fishing ring 45 and actuated to hook under ring 45 so that upward force may be applied through the fishing tool, which upward force moves locking collar 26 upward until spring arms 24 are free which movement upward engages locking collar on shoulders 43. Continued upward movement serves to disengage spring arms 24 by the wedging or camming action of the sloped shoulders of 35*a* with the sloped wall of channel 25 until the spring arms have moved away from abutment with member 18. Continued upward movement of the fishing tool results in upward force being applied to mandrel sleeve 20, which upward force is transferred through lower surface 53 into member 18. Since spring arms 24 no longer abut the top surface 55 of member 18, the member is urged to rotate in a clockwise direction by the action of sloping faces 54 and 56 against the upper and lower sloping portions of channel 15. The member will eventually disengage from channel 15, allowing the entire remainder of the mechanism along with the flow control device attached therebelow to be removed from the tubing.

It is preferable to arrange member 18 so that contact of its lower abutment surface 53 or arcuate surface 52 with the upper surface of sleeve 19 always occurs at a point substantially aligned with the center of rotation of member 18 about sleeve 20.

This arrangement is preferred so that the total amount of counterclockwise rotational moment generated in member 18 occurs as a result of contact at the upper surface 55. Thus, abutment of the lower surface of 18 merely serves to prevent downward movement of the member, and the locking action occurs only when setting sleeve 23 moves downward against surface 55.

Because of this relationship, disengagement of member 18 from channel 15 may be more easily accomplished, since the only forces acting on the member during disengagement are the upward force of sleeve 19, acting through the rotational center of member 18, and the rotational force of the upper sloped wall of channel 15 wedging against contact face 54. This upper wedging force serves to establish a rotational moment in the opposite direction, i.e. in a clockwise orientation, which opposite rotational moment serves to rotate member 18 back into its non-locking configuration associated with bore passage X—X, and disengagement of the lock from the sub is achieved.

Alternate Embodiment

Figure 5:
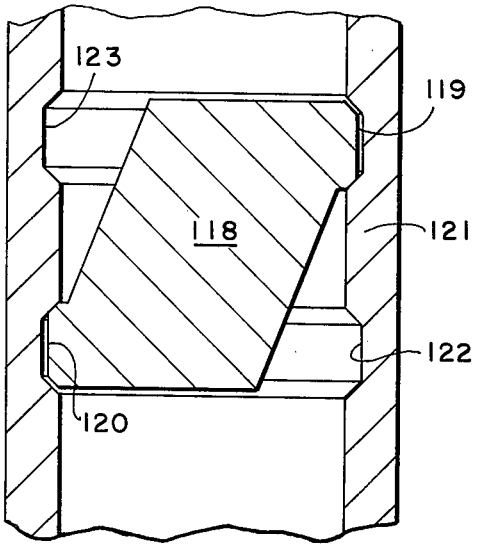
FIGS. 5 and 6 are directed to an alternate embodiment of the locking member.
Figure 6:
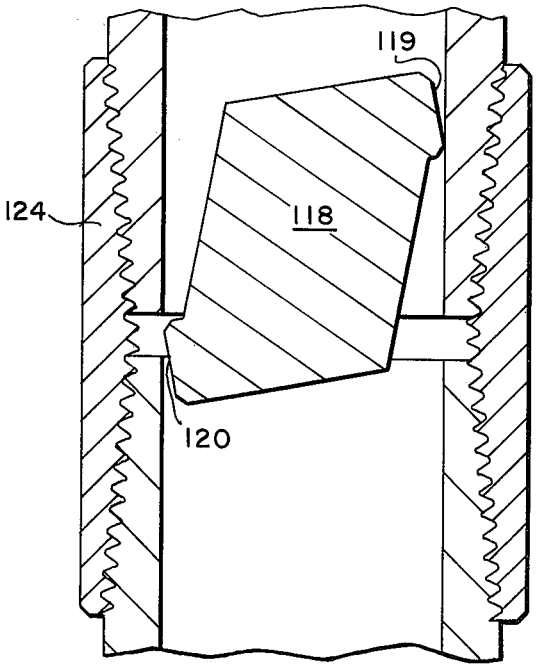

FIG. 5 illustrates an alternate embodiment of the locking member 118 having upper engagement shoulder 119 and a lower engagement shoulder 120. The locking member 118 is shown in FIG. 5 in place in a dual channel locking sub 121, wherein lower shoulder 120 is engaged in a lower channel 122, an upper shoulder 119 is engaged in an upper channel 123. In FIG. 6 is illustrated how the locking member is capable of transversing end gaps in tubing connected by collars or in casing connected by collars.

Although certain preferred embodiments of the invention have been herein described in order to provide an understanding of the general principles of the invention, it will be appreciated that various changes and innovations can be affected in the described locking mechanism without departing from these principles. For example, other means could be utilized to lock the tubular member into engagement in the landing sub; such means could include hydraulic means or rotational means. The invention, therefore, is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. A lock device for suspending flow control means in a landing nipple in an oil well tubing string, said lock device comprising:

an inner mandrel assembly having means at the top for connecting to a wireline;

tubular locking means located on said mandrel assembly in an encircling relationship thereon, said locking means adapted to pass through a tubing string and landing nipple in a first position thereof, and further adapted to engage a landing nipple in a second position thereof;

means on said mandrel assembly for selectively moving said locking member from said first position to said second position; and, wherein said locking means comprises a tubular, partially rotatable locking member slidably located on said sleeve means and arranged to be rotated into engagement with a landing nipple.

2. The lock device of claim 1 further comprising frangible release means engaging said mandrel assembly and said sleeve means and arranged upon shearing to allow release of said mandrel assembly from said sleeve means.

3. The lock device of claim 1 wherein said locking means further comprises a tubular mandrel sleeve encircling said inner mandrel assembly and passing through said locking member.

4. The lock device of claim 1 wherein said inner mandrel assembly comprises:

an upper mandrel;

a lower mandrel attached to said upper mandrel;

an abutment collar telescoped over said upper and lower mandrels;

biasing means abutting said upper mandrel and said collar and arranged to continuously bias said collar downward; and, abutment pin means engaging said collar and said lower mandrel.

5. The lock device of claim 1 wherein said tubular locking member comprises a generally cylindrical tubular body having a dual-axis bore passage therethrough, upper and lower abutment surfaces adjacent said bore passage, sloped channel engagement shoulders adjacent said abutment surfaces, and an arcuate pivot surface along one end thereof.

6. The lock device of claim 3 wherein said selective moving means comprises:

an inner setting sleeve slidably located on said mandrel sleeve, said setting sleeve having shouldered spring fingers at one end thereof;

a locking collar frangibly attached in telescopic arrangement on said setting sleeve and adapted to slide on and off of said spring fingers after shearing of said frangible attachment;

detent means between said locking collar and said setting sleeve; and, said mandrel sleeve having first channel means for receiving said detent means, and second channel means for receiving said shouldered spring fingers therein.

7. The locking assembly of claim 6 wherein said tubular locking member comprises a generally cylindrical member having a dual-axis bore passage therethrough for receiving said mandrel and mandrel sleeve therein, said member further having flat abutment surfaces at each end thereof, an arcuate pivot surface at one end thereof, and bevelled locking shoulders at each end thereof.

8. The locking assembly of claim 6 further comprising means for attaching a fishing tool to said locking collar.

9. A locking assembly for locking engagement in a conduit having an internal annular locking channel therein, said locking assembly comprising:

a generally cylindrical elongated inner mandrel adapted for placement inside a well tubing bore passage;

a slidable mandrel sleeve having an abutment shoulder and seal means thereon and being slidably attached on a portion of said mandrel;

shear means between said mandrel and said mandrel sleeve adapted to limit slidable movement therebetween;

a setting sleeve slidably mounted on said mandrel sleeve and having spring fingers thereon with shouldered ends;

a tubular locking member partially rotatably encircling said mandrel sleeve between said setting sleeve and said abutment shoulder;

a locking sleeve slidably mounted on said setting sleeve and frangibly attached to said mandrel sleeve, said locking sleeve arranged to telescope over said spring fingers to prevent outward flexing thereof;

an abutment collar on said mandrel arranged to abut said locking collar and having biasing means engaging said mandrel and arranged to continuously bias said abutment collar against said locking collar;

first detent means between said setting sleeve and said locking collar and arranged to engage a channel in said mandrel; and, second detent means between said abutment collar and said mandrel and adapted to engage an inner wall of a landing nipple.

* * * * *